US006431415B1

(12) United States Patent
Schreiber

(10) Patent No.: US 6,431,415 B1
(45) Date of Patent: Aug. 13, 2002

(54) POPCORN FUNNEL

(76) Inventor: Stephen B. Schreiber, R. D. 2, Box 162, Red Hook, NY (US) 12571-9564

( * ) Notice: Subject to any disclaimer, the term of this patent is extended or adjusted under 35 U.S.C. 154(b) by 0 days.

(21) Appl. No.: 08/996,842

(22) Filed: Dec. 23, 1997

(51) Int. Cl.[7] ..... B65D 88/26
(52) U.S. Cl. ..... 222/460; 222/462; 222/570
(58) Field of Search ..... 222/192, 460–462, 222/566, 569, 570; 141/331, 332, 335, 337, 338, 339, 344, 345; 229/5.5, 125.36; 220/855 P; 285/257, 258, 260; 215/235

(56) References Cited

U.S. PATENT DOCUMENTS 3,072,277 A * 1/1963 Hoffmann ..... 215/253
3,537,623 A * 11/1970 Fisher ..... 222/460

FOREIGN PATENT DOCUMENTS

CH 172689 * 10/1934 ..... 222/461

* cited by examiner

*Primary Examiner*—Joseph A. Kaufman
(74) *Attorney, Agent, or Firm*—Joseph B. Taphorn

(57) ABSTRACT

A popped-popcorn package consists of a beaded container for holding popped-popcorn and a funnel having a closable opening in the reduced end for dispensing several kernals of normal-sized popped popcorn at a shake of the package and an enlarged end for seating non-removably over the beaded open mouth of the container.

24 Claims, 5 Drawing Sheets

POPCORN FUNNEL

BACKGROUND OF THE INVENTION

1. Field of Invention

This invention relates to a dispenser for granulated items and more particularly to a dispenser for consuming popped-popcorn in movie houses, entertainment arenas, amusement parks and the like.

Popped popcorn, the kernels of which are normally of a length of ¾" to one inch, is usually marketed in entertainment venues in open containers from which the individual kernels are removed by extending a hand into the container. A problem with the open container is that popcorn is easily spilled therefrom, mandating expensive clean-up operations on the part of the movie house management. Another problem involves sanitation in that when others reach into the container to help themselves to the popped popcorn, contamination takes place which abets the transfer of communicable diseases.

2. Description of the Art

The prior art includes U.S. Pat. Nos. 1,691,306; 3,159,314; 2,740,229; and 3,750,722. U.S. Pat. No. 1,691,306 shows a package for dispensing loose confections. U.S. Pat. Nos. 3,159,314 and 2,740,229 show generally funnel-shaped mechanisms for dispensing canned products (e.g. coffee) and insect powder, respectively. U.S. Pat. Nos. 3,750,722 and 4,034,901 show generally funnel-shaped mechanisms for dispensing liquids such as oil and paint, respectively.

SUMMARY OF THE INVENTION

A main objective of the invention is to provide a convenient popped- popcorn package from which the popcorn is not easily spilled.

Another object of the invention is to provide a convenient popped-popcorn package whose contents are protected from consumer contamination.

Still another object of the invention is to provide a spill-proof and contamination-proof popped-popcorn package from which the popcorn is easily dispensed and in desired quantities.

Yet another object of the invention is to provide a dispensing top which can be easily applied to a popped-popcorn conventional container utilized in movie houses.

A further object of the invention is to provide a dispensing top which is simple and easy and inexpensive of manufacture.

The objects of the invention are achieved by creation of a generally conical-shaped top of a length of about 4½" and having at its upper end a dispensing opening one inch or greater enabled to pass only several kernels of popped-popcorn at a time, and at its lower end an opening usually 4½" and sufficient to cover the opening across the popped-popcorn container and means for attaching the top to the container. The upper end of the top preferably is formed with easily-operable means consisting of flaps normally closing off the dispensing opening. The top may be formed from paper or plastic materials. If formed of paper, the means for attaching the top to the container consists of in-turned tabs at the bottom edge of the top and which are of such lengths as to pass below the bead of the container but not of such length as to not undergo compression when an effort is made to separate the top from the container.

An advantage of the invention is that a popped-popcorn package consisting of a normal popped-popcorn container covered with the dispensing top may safely be carried in a non-upright position into the movie theater.

A related advantage of the invention is that the popped-popcorn package even when opened will not spill kernels easily when held or laid horizontally as in a lap.

Another advantage of the invention is that the popcorn will only dispense in incremental amount from the package when shook in upside-down position. The funnel-shaped top has a short squat (versus long and thin) taper which serves to jam the popped-popcorn, allowing only a few kernels to pass through the dispensing opening at a time.

Yet another advantage of the invention is sanitary dispensing, the kernels remaining in the popped-popcorn package not being touched by hands receiving the dispensed kernels.

A further advantage of the invention is that the popped-popcorn package facilitates easy and thorough mixing with the kernels of salt, butter and other ingredients or flavors dictated by the individual customer's tastes.

Still another advantage of the invention is that the popped-popcorn is kept warmer for the consumer, the top reducing cooling air flow over the popcorn.

A feature of the invention is that a set of the dispensing tops can be stored in a movie house without requiring much room. The conical-shape of the tops permits their nesting in a compact arrangement from which individual ones can be readily removed.

BRIEF DESCRIPTION OF THE INVENTION

The above objects, advantages and features of the invention will be apparent from a consideration of the following description of illustrative embodiments of the invention when taken together with the accompanying drawings wherein.

DETAILED DESCRIPTION OF THE INVENTION

Figure 1:
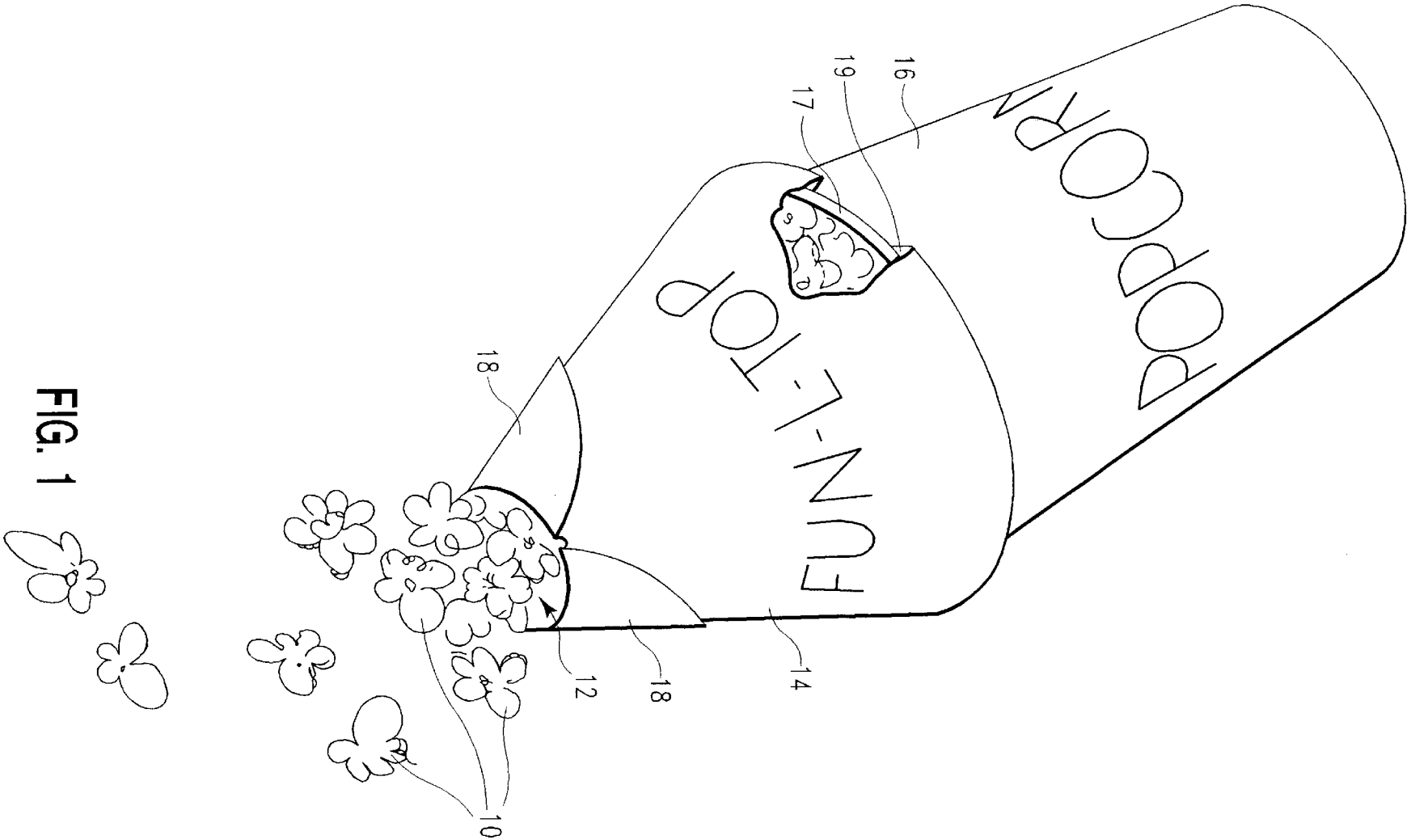
FIG. 1 is a view in perspective of a popped-popcorn package turned upside down for dispensing.

Referring now to FIG. 1 of the drawings, there is shown therein a popped-popcorn package embodying the invention. The package is shown in a generally upside down position that it would be held-in for dispensing by shaking. Popped-popcorn kernels 10 which normally are of a length of ¾" to 1" are shown as emanating from an opening 12 of a diameter of about 1½" roughly double the length of a normal sized popped-popcorn kernel, formed in the reduced end of a generally conical-shaped top 14 (here shown as the frustum of a right circular cone) formed of a paper material. The opening 12 is large enough to pass two kernels of popped-popcorn side by side The top 14 at its base is seated on the enlarged, open end of a normal container 16 used in movie houses. The container is formed with a bead 17 about its mouth. The container may be formed of paper or plastic.

The general shape of the top will be short and squat to allow the popped-popcorn to jam at the opening after the desired amount of several kernels have been dispensed.

Figure 3:
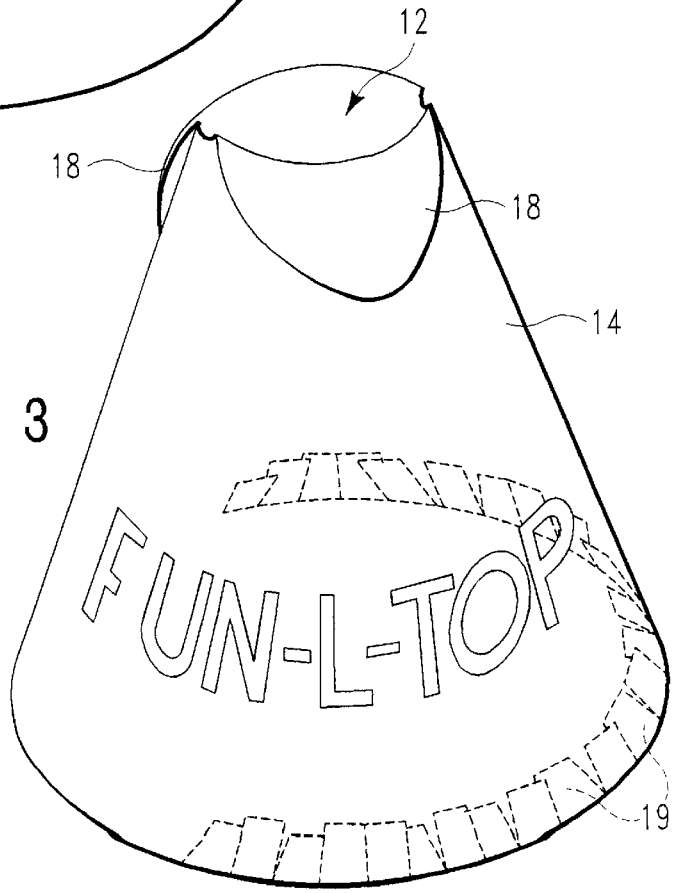
FIG. 3 is a view in perspective of the same top with its dispensing opening opened.
Figure 4:
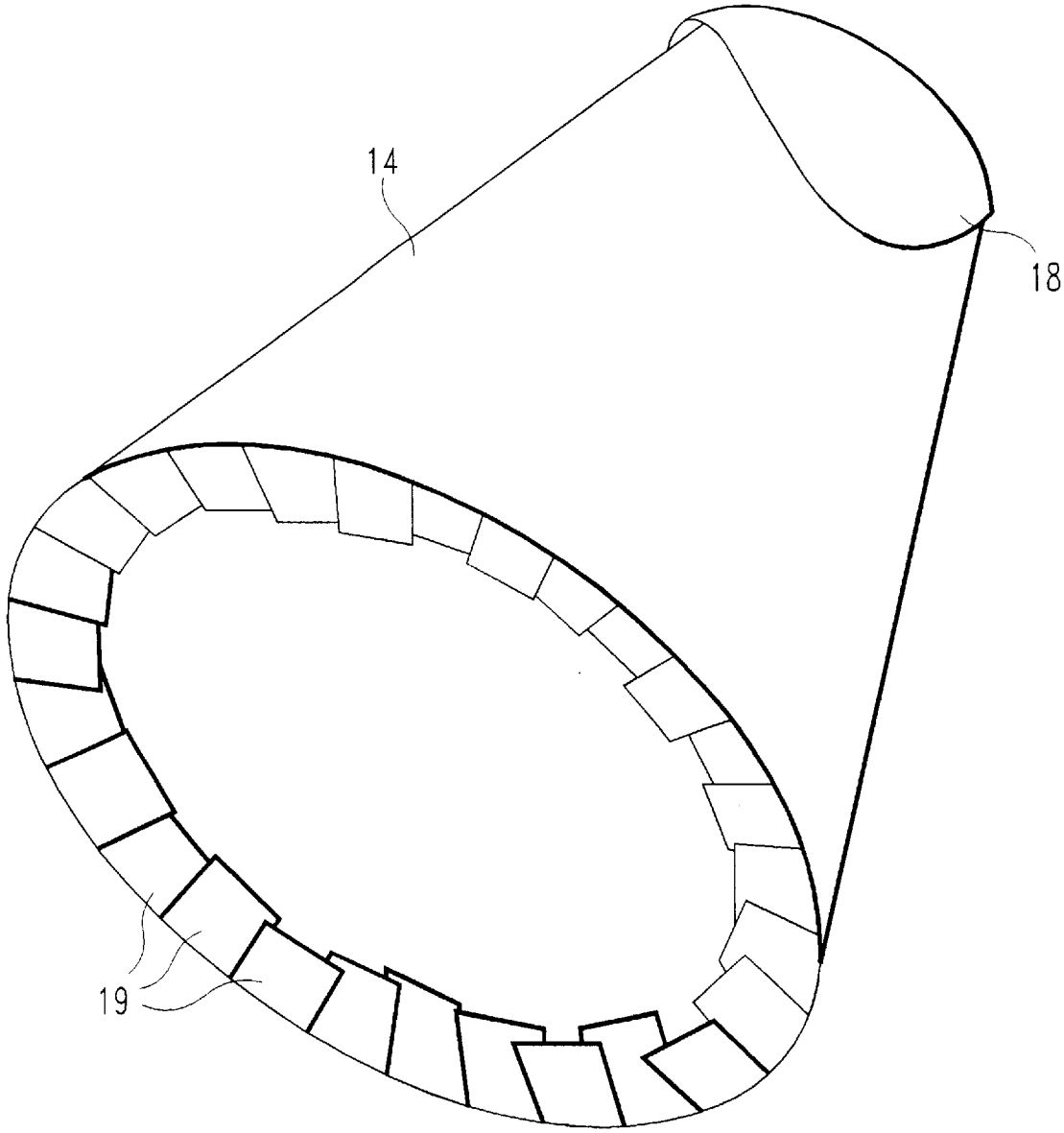
FIG. 4 is a view in perspective of the same top from a point below its bottom, to show its means for attaching to a container.

The top 14 in FIGS. 1, 3, and 4 is shown held securely to the container 16 over its mouth by tabs 19. The tabs 19 are of such length that when the interior surfaces of the top by virtue of its conical shape come to rest on the bead 17 of the container 16, their free ends terminate below the bead 17. However they are of greater length than the distance between the lower edge of the come 14 and the container bead 17. Thus if an effort is exerted to separate the cone 14 after it is has been placed on the container 16, the tabs 19 come under compression because their free ends are stopped by the bead 17 and they are longer than the distance between the cone and the bead. As a result, the top cannot be separated from the container unless as force sufficient to crush the tabs 19 is applied. On the other hand, the inwardly turned tabs readily swing about their port of anchor to the lower end of the cone, to permit easy placement of the top on a container.

Figure 2:
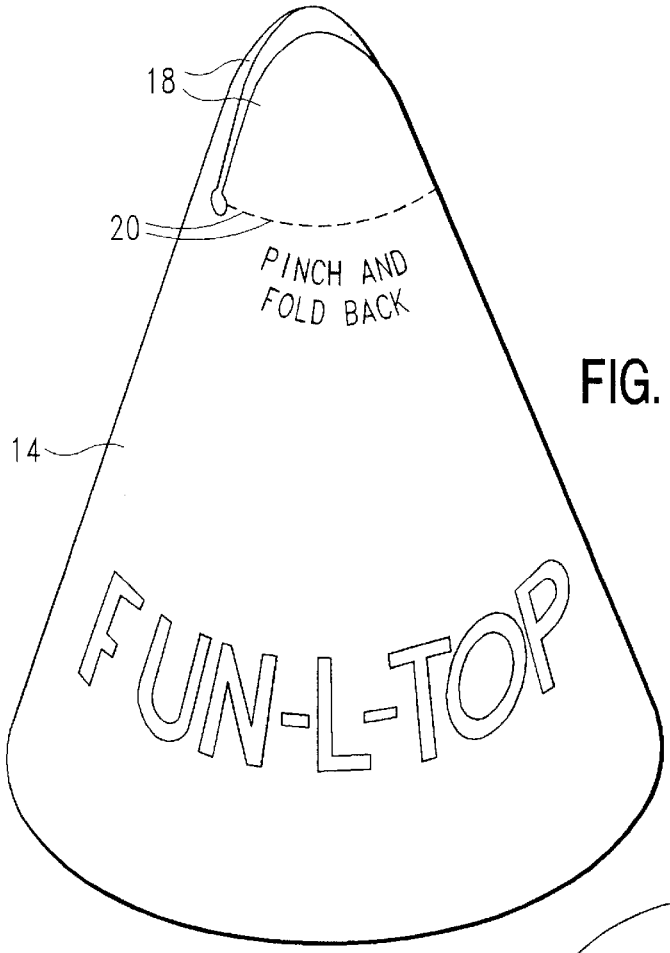
FIG. 2 is a view in perspective of a popped-popcorn dispensing top formed of a paper material and with its dispensing opening closed.

The top 14 is shown in FIG. 2 with its dispensing opening at its reduced end closed. The closure is effected by a pair of flaps 18 formed by separating the upper, closed end or vertex of the conically-shaped top 14 in-two for the distance necessary to form the desired size opening 12 shown in FIG. 1 when the flaps 18 are down. At the level of the opening 12 generally defined by the lower end of the separation of the flaps 18, the top 14 may be formed in its sides with one or more depressions or holes 20 forming weak spots in the material to provide a folding line for the flaps 18.

The top 14 is changed from its closed condition in FIG. 2, to the condition with its opening 12 opened (FIGS. 1 & 3), by pressing the sides of the top below the two flaps 18 together, generally below the line of the depression 20. With the inward movement of the opposing sides of the top at this point, the flaps 18 can be manually swung outward about the lower end of their point of separation and of any depressions 20 and downward onto the outer surface of the conical top 14, where they remain due to the locking effect of the geometry involved. (This geometry involves the general circularness of the opening 12 and the reversed conical shapes of the flaps 18.)

The movement of the flaps 18 to downward position may be abetted by manual engagement with their free ends. To facilitate this manual engagement, one tab is formed slightly longer than the other (see FIG. 2) to enable its ready grasping and movement away. The other tab can then be easily pushed in the other direction.

It should be noted, however, that the top can be restored to closed condition as by compressing the cone's upper end and slipping the fingers underneath the flaps 18 to push them up and together again. On decompression of the cone, the flaps regain the cone contour and remain closed. This reclosure procedure facilitates consumption at intervals.

Figure 5:
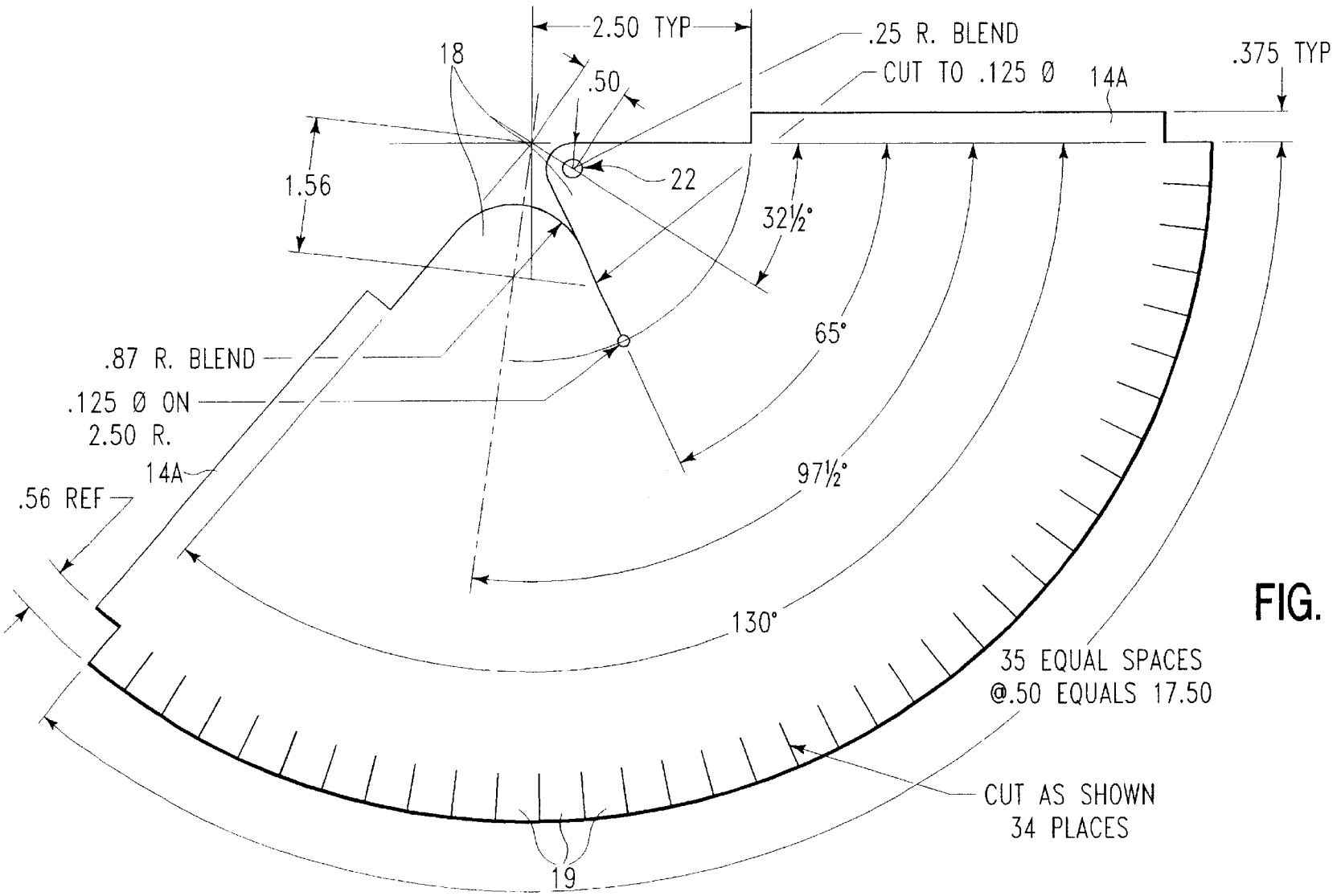
FIG. 5 is a plan view of a paper material cut to form a dispensing top when fabricated.

The disk-sector shape of a paper material cut to form a dispensing top when fabricated is shown in FIG. 5. The tabs 19 are cut in the circular outer edge of the disk-sector, and will be folded over so as to extend upwards into the interior of the fabricated conical top.

The flaps 18 are cut in at the center of the disk-sector, the free end of one having a greater radius than that of the other to make it the shorter one and provide the dissimilar length shown in FIG. 2. The free sides of this disk-sector are formed with extensions 14A which may be coated with glue on respective sides to hold the paper material in a cone shape when the sides of the disk-sector are folded together about its center-point.

Popped-popcorn dispensing tops would be distributed to movie houses and the like normally as stacked cones; their conical shape facilitating dense packaging arrangements. Popped-popcorn selling persons would fill a container 16 with popped popcorn, remove a top 14 from the top or bottom of a stack, and place the same on the container. In the case of the designs of FIGS. 1–5, the tabs 19 would pass below the bead 17 of the container to lock the top thereon.

The customer, upon taking his seat in the movie theater, would press the side of the cone below the flaps 18 together with one hand. With the other hand, he would move the longer flap down, and then the other. He would then release the sides of the cone to lock the flaps in their down position. Popped-popcorn may now be dispensed by inverting and/or shaking the container.

A feature of this invention is that the longer one of the flaps 18 of a top 14 may be formed with an aperature 22 to facilitate hanging the top 14 as on a nail. The friction between the tops of a stack may be made such that a number of tops can be suspended when the top one is hung, enabling removal of only the bottom one by the sales person.

Another feature of the invention is that the shape (taper) of the cone can be varied to change the amount of popcorn dispensed on a shake. The conical shape of the top 14 causes the popcorn to jam in the cone with the result that only a limited number of kernels will pass out through the opening 12. The longer (less tapered) the cone, the earlier the jamming that occurs; the shorter the later. This feature allows the dispensing amount to be adjusted without corresponding changes in the size of the opening 12, which size may also be related to the size of the palm of the average user. Of course, the size of the opening 12 may also be changed to vary the amount of popcorn dispensed.

Figure 6:
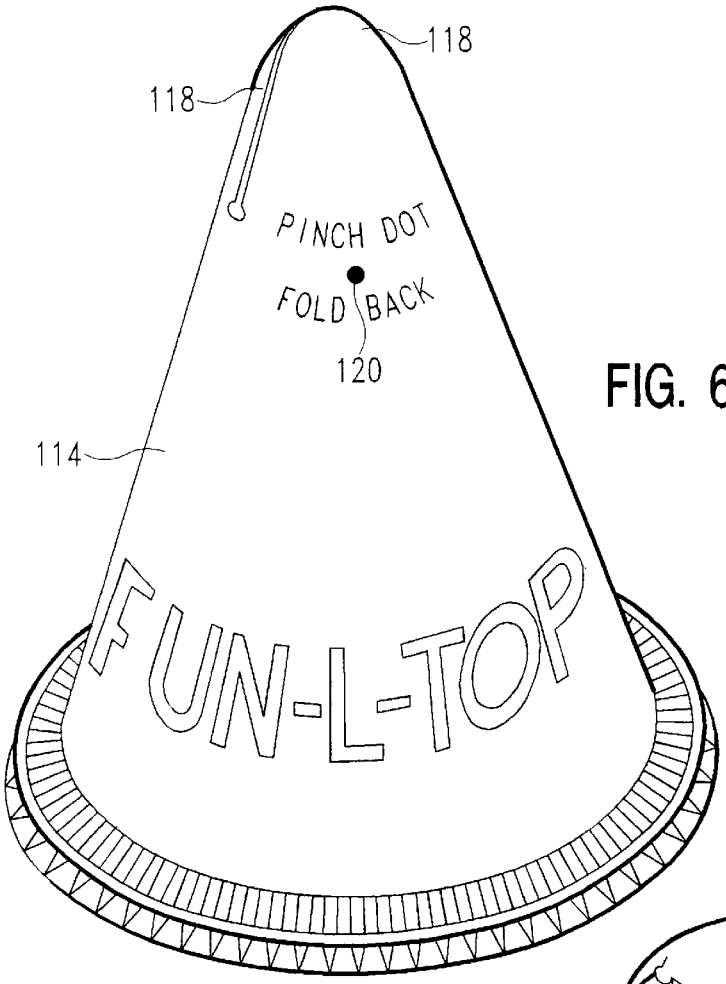
FIG. 6 is a view in perspective of a popped-popcorn dispensing top formed of a plastic material and with its dispensing opening closed.
Figure 7:
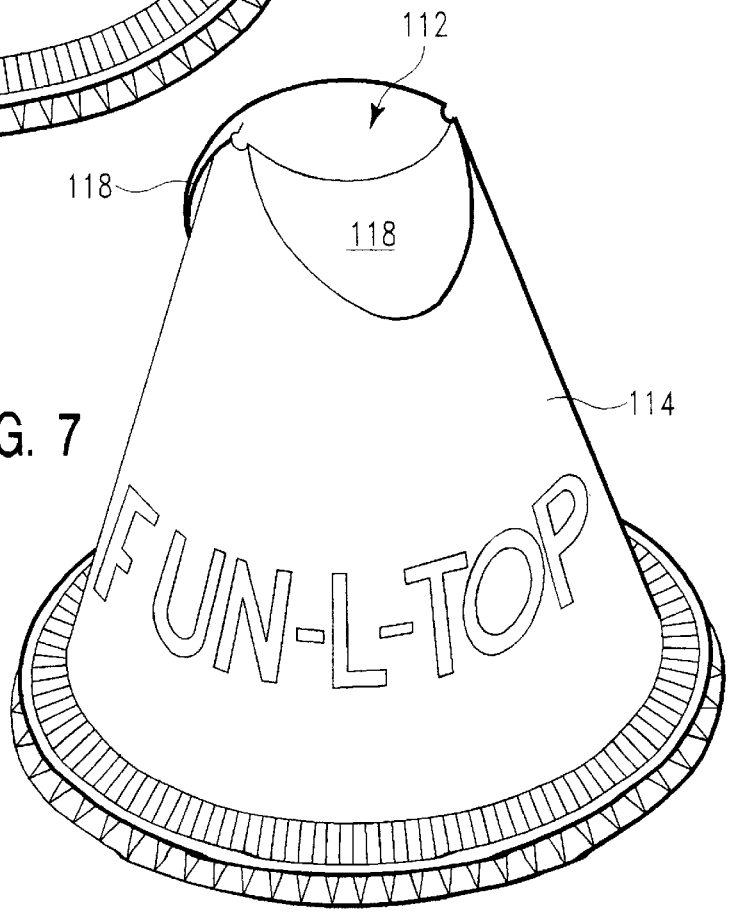
FIG. 7 is a view in perspective of the same top with its dispensing opening opened.

A popped-popcorn dispensing top formed of plastic material is shown in FIGS. 6 and 7. A conical-shaped top 14, which may be vacuum formed or injection molded, is formed at its upper end with flaps 118 which when moved aside in the manner heretofore described for the paper-material embodiment of FIGS. 1–5 upon initially pressing dot 120 against a corresponding spot on the opposite side of the top, defines a dispensing opening 112. The lower end of the cone is formed with means conventional in the art for attachment to a popped-popcorn container.

It will be evident that a popped-popcorn package constructed according to the invention can be carried even in a non-upright position without danger of spilling its contents. Further, that even after the top has been opened by moving the flaps 18, inadvertent spilling, such as when laying the package horizontally in a lap, is minimized due to the jamming effect of the tapered (cone) shape of the top 14. Sanitary dispensing occurs as hands do not reach into the container 16 to separate some kernels from the rest; with the applicant's package, only already dispensed kernels are received in a hand. The popped-popcorn remaining in the container at any time remains warmer because of the covering effect of the top 14 and the relative smallness and remoteness of the top opening 12 minimizing cooling air flow over the kernels. The closed nature of the popped-popcorn package also enables the contents of the package to be tailored to the individual customer's desires; salt, butter, and other ingredients or flavors may be added before the top 14 is placed on the container 16 and the package shook to mix the ingredients with the popped-popcorn.

It will be appreciated that the foregoing is to be considered as illustrative only of the principles of the invention, and that while certain novel features of the invention have been shown and described, various omissions, substitutions and changes in the forms and details of the devices illustrated and in their use and operation can be made by those skilled in the art, without departing from the spirit of the invention.

What is claimed is:

1. A dispensing top for passing only several kernels of a popped popcorn at a time from an open-ended container filled with popped popcorn, having a generally conical shape and an opening at each end, the opening at the reduced end being of a diameter greater than one inch and allows several kernels of popped popcorn to pass through at the same time, and means at the enlarged end of the top to embrace the open end of the container, the taper of the top being uniform and such as to by itself jam up the popped popcorn at the end of the cone and permit the dispensing of only a few kernels at a shake of the container when the top is mounted on the container.

2. A dispensing top according to claim 1, and the container having the popped popcorn, the open end of the container being embraced thereat by the dispensing top to form a package.

3. A dispensing top for passing only several kernels of popped popcorn at a time from an open-ended container filled with popped popcorn, having a generally conical shape and an opening at each end, the opening at the reduced end being of a diameter greater than one inch and allows several kernels of popped popcorn to pass through at the same time, means at the enlarged end of the top to embrace the open end of the container, the taper of the top being uniform and such as to by itself jam up the popped popcorn at the end of the cone and permit the dispensing of only a few kernels at the shake of the container when the top is mounted on the container, and means at the reduced end of the top to close-off the opening thereat.

4. A dispensing top according to claim 3, and the container having the popped popcorn, the open end of the container being embraced thereat by the dispensing top to form a package.

5. A dispensing top for an open-ended container filled with popped popcorn, having a generally conical shape and an opening at each end, the opening at the reduced end being enabled to pass several kernels of popped popcorn to pass at a time, means at the enlarged end of the top to embrace the open end of the container, the taper of the top being uniform and such as to by itself jam up the popped popcorn before the end of the cone and permit the dispensing of only a few kernels at the shake of the container when the top is mounted on the container, and means at the reduced end of the top to close-off the opening thereat; wherein the means at the reduced end of the top to close-off the opening thereat are two flaps constituting the vertex of the generally conically-shaped top.

6. A dispensing top according to claim 5 wherein the top includes means at the level of the bottom of the flaps to facilitate outward swinging movement of the flaps to open position.

7. A dispensing top according to claim 6, and the container having the popped popcorn, the open end of the container being embraced thereat by the dispensing top to form a package.

8. A dispensing top according to claim 5 wherein one of the two flaps is shorter than the other to facilitate moving the flaps to the open position.

9. A dispensing top according to claim 8 wherein the longer flap has an aperature for hanging the top.

10. A dispensing top according to claim 8, and the container open end being embraced thereat by the dispensing top to form a package.

11. A dispensing top according to claim 5 wherein the top is formed from paper cut in a sector of a disk and fastened together to form the conical shape.

12. A dispensing top according to claim 11 wherein the sector of the disk on its circular edge is cut into tabs which are folded under to constitute the means at the enlarged end of the top to embrace the open end of the container by engaging a bead thereon.

13. A dispensing top according to claim 5, and the container having the popped popcorn, the open end of the container being embraced thereat by the dispensing top to form a package.

14. In a dispensing device, a conically-shaped dispensing mechanism having a vertex, said vertex being divided in-two to form opposing flaps, said division being to a depth to provide a desired size opening when the sides of the conically-shaped dispensing mechanism in line with the flaps are pushed together to enable swinging the flaps outward and downward.

15. A dispensing device according to claim 14 having weaknesses formed in the conically-shaped dispensing mechanism at the level of the depth of the division of the flaps to facilitate outward swinging movement of the flaps to open position.

16. A dispensing top according to claim 15, and the container open end being embraced thereat by the dispensing top to form a package.

17. A dispensing top according to claim 14, and the container open end being embraced thereat by the dispensing top to form a package.

18. A disk-sector for fabricating a conically-shaped dispensing top having attachment tabs at its enlarged end and two opening-closing flaps constituting the vertex of the conically-shaped top at its pointed end, wherein said attachment tabs are cut in side-by-side relation in disk-sector's circular periphery, and said opening-closing flaps are formed at the disk sector's center.

19. A mechanism for holding a conically-shaped top having a generally circular edge onto a container having a generally circular edge formed with a bead, including tabs of the same material as the rest of the top and folded over therefrom to define creases about which they are yieldably pivoted thus readily swingable on said top's circular edge for freely passing over the bead in one direction only and for resistively interacting with the bead when moved in the opposite direction thereafter to lock the top onto the container and preclude its removal without destroying the container or the top or a tab, said tabs having their free ends extending towards the container but being freely movable.

20. A mechanism for holding a conically-shaped top onto a container formed with a bead, including inwardly and upwardly extending tabs of the same material as the rest of the top and folded over therefrom to define creases about which they are yieldably pivoted on the enlarged end of the top and which freely pass over the bead on sliding the top down onto the container and thereafter resistively interact with the bead when the top is moved in the opposite direction to lock the top onto the container to preclude top removal without destroying one of the top or its tabs or container, said tabs having their free ends extending towards the container but being freely movable.

21. A dispensing top for passing only several kernels of a popped popcorn at a time from an open-ended container filled with popped popcorn, having a generally conical shape and an opening at each end, the opening at the reduced end being about one and one-half inches in diameter and allows several kernels of popped popcorn to pass through at the same time, and means at the enlarged end of the top to embrace the open end of the container, the taper of the top being uniform and such as to by itself jam up the popped popcorn at the end of the cone and permit the dispensing of only a few kernels at a shake of the container when the top is mounted on the container.

22. A dispensing top for passing only several kernels of a popped popcorn of an average length of three-fourths to one inch at a time from an open-ended container filled with popped popcorn, having a generally conical shape and an opening at each end, the opening at the reduced end being about one and one-half inches in diameter and allows several kernels of popped popcorn to pass through at the same time, and means at the enlarged end of the top to embrace the open end of the container, the taper of the top being uniform and such as to by itself jam up the popped popcorn at the end of the cone and permit the dispensing of only a few kernels at a shake the container when the top is mounted on the container.

23. A dispensing top for passing only several kernels of a popped popcorn of an average length of three-fourths to one inch at a time from an open-ended container filled with popped popcorn, having a generally conical shape and an opening at each end, the opening at the reduced end being about one and one-half inches in diameter and allows several kernels of popped popcorn to pass through at the same time, and means at the enlarged end of the top to embrace the open end of the container, the taper of the top being uniform and such as to render the top short and squat so that it can by itself jam up the popped popcorn at the end of the cone and permit the dispensing of only a few kernels at a shake of the container when the top is mounted on the container.

24. A dispensing top of a length of about four and a half inches for passing only several kernels of a popped popcorn at a time from an open-ended container filled with popped popcorn, having a generally conical shape and an opening at each end, the opening at the reduced end being of a diameter greater than one inch and allows several kernels of popped popcorn to pass through at the same time, and means at the enlarged end of the top to embrace the open end of the container, the taper of the top being uniform and such as to render the top short and squat so that it can by itself jam up the popped popcorn at the end of the cone and permit the dispensing of only a few kernels at a shake of the container when the top is mounted on the container.

* * * * *